US006171016B1

(12) United States Patent
Pauls et al.

(10) Patent No.: US 6,171,016 B1
(45) **Date of Patent: *Jan. 9, 2001**

(54) TUBULAR REINFORCING DOWEL SYSTEM AND METHOD

(75) Inventors: Dennis A. Pauls, Wichita; John Thomas Whiteman, El Dorado, both of KS (US)

(73) Assignee: Concrete Systems, Inc., Augusta, KS (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/175,299

(22) Filed: Oct. 20, 1998

(51) Int. Cl.[7] ..... E01C 11/14

(52) U.S. Cl. ..... 404/64; 404/59; 404/62; 404/65; 52/390.17

(58) Field of Search ..... 52/309.15, 309.17, 52/393, 396.02, 720.1, 721.4; 404/62, 67, 63, 64, 59, 58

(56) References Cited

U.S. PATENT DOCUMENTS 1,279,431 * 9/1918 Poulston .
2,162,467 * 6/1939 Brickman et al. ..... 404/59
2,319,050 * 5/1943 Fischer et al. .
2,370,153 * 2/1945 Fischer .
2,829,572 * 4/1958 Vanek .
3,059,553 * 10/1962 Woolley .
3,329,072 * 7/1967 Rice .
3,397,626 * 8/1968 Kornick et al. .
3,702,093 * 11/1972 Van De Loock et al. ..... 94/8
3,769,127 * 10/1973 Goldsworthy ..... 156/173
3,925,090 * 12/1975 Head ..... 106/87
4,578,916 * 4/1986 Witschi ..... 52/396
5,613,334 * 3/1997 Petrina ..... 52/223.1

* cited by examiner

*Primary Examiner*—Eileen D. Lillis
*Assistant Examiner*—Raymond W Addie
(74) *Attorney, Agent, or Firm*—Shughart Thomson & Kilroy P.C.

(57) ABSTRACT

A tubular reinforcing dowel system includes a plurality of fiber composite hollow, tubular dowel tubes comprising a first material and each including a longitudinally-extending bore. The dowel tube bores are filled with a second material, such as hydraulic cement, to form dowel members. The dowel members are mounted on a basket assembly which includes a pair of horizontal runners and multiple, longitudinally-aligned pairs of stands mounted on the runners. Each stand is connected to a respective dowel member end. A reinforcing method includes the steps of mounting multiple reinforcing dowel members on a basket assembly, placing the basket assembly on a crushed rock base of a roadway and pouring a cement slab on top of the base and encasing the dowel members underneath a transverse construction joint.

16 Claims, 3 Drawing Sheets

TUBULAR REINFORCING DOWEL SYSTEM AND METHOD

BACKGROUND OF THE INVENTION

1. Field of the Invention

The present invention relates generally to concrete reinforcing, and in particular to a reinforcing dowel system and method for concrete slabs.

2. Description of the Prior Art

A typical method of constructing roadways and highways involves pouring a concrete slab over a suitable base course of crushed rock or other material. Concrete is often the preferred material for roadway slabs because it tends to be relatively strong, durable, and cost-effective over the life of a roadway or highway. Moreover, a well-designed and well-constructed concrete roadway may be less susceptible to potholes and the need for resurfacing than a comparable asphalt roadway. The interstate highway system and other major roadways are therefore constructed largely of concrete.

In order to maximize the useful life of a concrete roadway, the design must accommodate various loads to which the slab is subjected and the stresses resulting therefrom. For example, thermal loads result from variations in the ambient temperature. Annual temperature variations of more than 60 degrees Celsius are not uncommon in many areas. Expansion/contraction cycles from temperature changes can be accommodated somewhat by forming construction or expansion joints at regular intervals to allow relative movement between adjacent slab sections. Expansion joints usually comprise gaps between adjacent concrete slabs. The gaps are filled with resilient materials, such as an elastomeric caulk. The caulk expands and compresses in response to the thermal loads on the slabs. Concrete normally reaches its design strength approximately 28 days after it is poured. Partially-cured or "green" concrete can be saw cut relatively easily. Therefore, construction and expansion joints are often cut in concrete slabs when they are partially cured and the fresh concrete is green.

Special slip-forming equipment is commonly used for pouring continuous slabs for concrete roadways. Cracks are expected in large concrete slabs, such as roadways constructed with slip-forming equipment. The crack locations can be controlled by sawing concrete slabs part-way through to form construction joints. Weakened areas are thus formed with less cross-sectional area to resist bending and other stresses. By providing such joints at periodic intervals, cracks are generally limited to the areas of the construction joints whereby intermediate areas tend to remain intact. After partial saw cut construction joints have been formed, a slab will tend to crack along them. The slab will thus be effectively divided into multiple slab sections.

In conventional reinforced concrete roadway construction, steel reinforcing rod dowels are placed across the areas in which the construction joints are cut. The dowels transfer loads between the slab sections. Otherwise the slab sections could act as independent structural elements separated from each other by cracks along their respective construction joints. However, with the construction joints spanned by reinforcing dowels, the adjacent slab sections are generally retained in alignment with each other.

A common practice to accommodate expansion and contraction of the adjacent slab sections is to apply a coat of grease to one end of each reinforcing dowel to permit limited longitudinal slippage. The grease-coated end of a reinforcing dowel can thus reciprocate slightly within the concrete slab in which it is encased.

In conventional concrete slab construction, the dowels are typically secured in place by wire baskets while the concrete slab is being poured. The baskets are adapted for placement on a crushed rock roadway base. The dowels are thus supported over the roadway base at predetermined heights and can be placed approximately medially within the slab.

Such prior art dowel and basket combinations suffered from several disadvantages. For example, the relatively small diameters of the steel reinforcing bar dowels tended to concentrate shear forces over relatively small contact areas. The aforementioned technique of coating one end of a dowel with grease tended to introduce annular clearance between the slab and the dowel. This clearance could lead to the dowels working themselves even more loose after being subjected to relatively large dynamic loads over prolonged periods of time. Loose dowels can lead to premature slab deterioration and failure.

Moreover, previous basket designs included reinforcing wire members which extended across a construction joint. The normal procedure was to cut these joint-spanning wires before the cement was placed. Omitting this step could result in "locked" construction joints. Previous basket designs also interfered with concrete pouring operations.

Heretofore there has not been available a tubular reinforcing dowel system and method with the advantages and features of the present invention.

SUMMARY OF THE INVENTION

In the practice of the present invention, a tubular reinforcing dowel system is provided which includes a plurality of dowel members each comprising a hollow dowel tube and a dowel core. The dowel tube comprises a first material, such as composite fiber or stainless steel. The dowel core comprises a second material, such as hydraulic cement. A basket assembly includes a pair of horizontal runners and a plurality of stands mounted in corresponding, longitudinally-opposed pairs on respective runners. In the practice of the method of the present invention, a roadway is constructed with a crushed rock base and a concrete slab poured thereover. A plurality of dowel members are mounted on a basket assembly by securing the dowel member ends to the basket assembly stands. The basket assembly is then placed on top of the crushed rock base. The slab is poured on top of the crushed rock base and encases the dowel members. A construction joint is saw-cut into the slab over the dowel members.

OBJECTS AND ADVANTAGES OF THE INVENTION

The principal objects and advantages of the present invention, include: providing a tubular reinforcing dowel system; providing such a system with dowel members constructed out of materials which resist corrosion; providing such a system which provides greater effective dowel member diameters than previous systems with steel reinforcing bar dowels; providing such a system which can reduce the stress per unit of contact area between the dowel members and concrete slabs in which they are encased; providing such a reinforcing system which minimizes high stress contact areas between the dowel members and the concrete; providing such a reinforcing system which utilizes relatively inexpensive composite materials in combination with relatively inexpensive cement cores; providing such a reinforcing system which provides relatively high tensible strength and flexibility with a tubular composite fiber dowel tube and a hydraulic cement core with relatively high compressive strength; providing such a reinforcing system which can eliminate the need for applying a coat of grease to parts of the dowel members at construction joints; providing such a reinforcing system which can reduce the clearance between the dowel members and a slab; providing such a reinforcing system which maintains relatively tight joints between the dowel members and a slab; providing such a reinforcing system which eliminates locations where water can collect and freeze; providing such a reinforcing system which provides "hinge" type flexibility in the area of a construction joint in a concrete slab; providing such a reinforcing system with an improved basket assembly for positioning the reinforcing dowel members; providing such a reinforcing system which eliminates the need for basket assembly wires extending across a construction joint; providing such a reinforcing system which can reduce the steps in construction and installation of dowel reinforcing in a slab by eliminating the steps of cutting wires in a basket assembly; providing such a reinforcing system which can prolong the useful operational life of a roadway or highway; providing such a reinforcing system which is economical, efficient and particularly well adapted for the proposed usage thereof; and providing a method of reinforcing a concrete slab.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
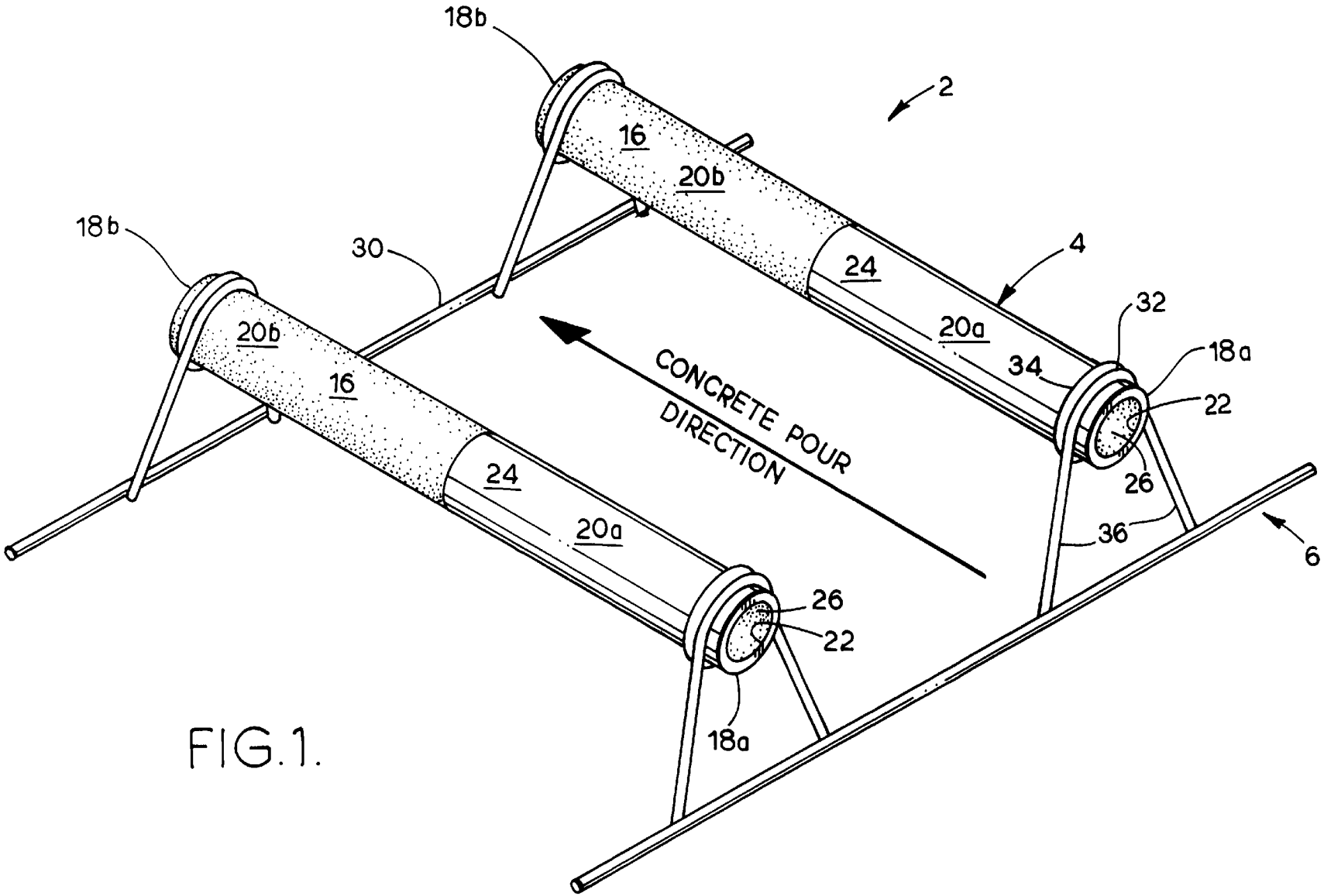
FIG. 1 is an upper, perspective view of a tubular reinforcing dowel system embodying the present invention.
Figure 2:
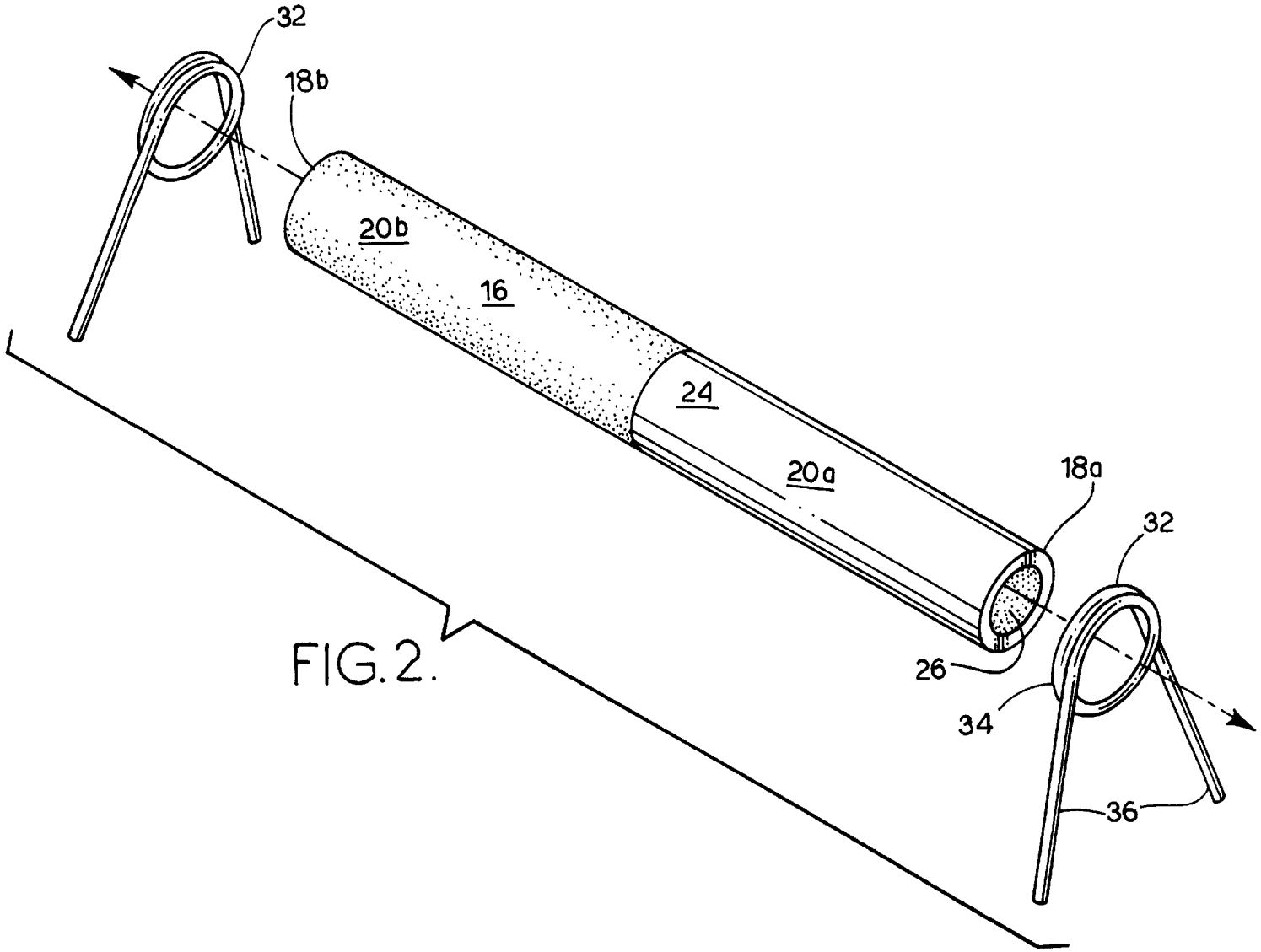
FIG. 2 is a fragmentary, upper, exploded perspective view thereof showing a dowel member and a pair of stands for supporting same.
Figure 3:
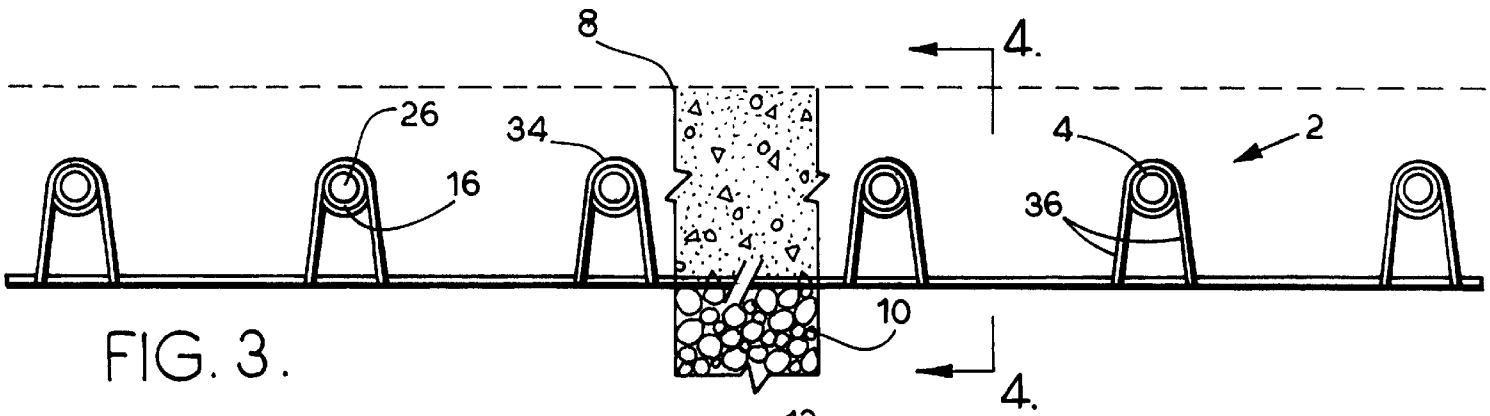
FIG. 3 is a fragmentary, vertical, cross-sectional view of a roadway with the tubular reinforcing dowel system embodying the present invention.
Figure 4:
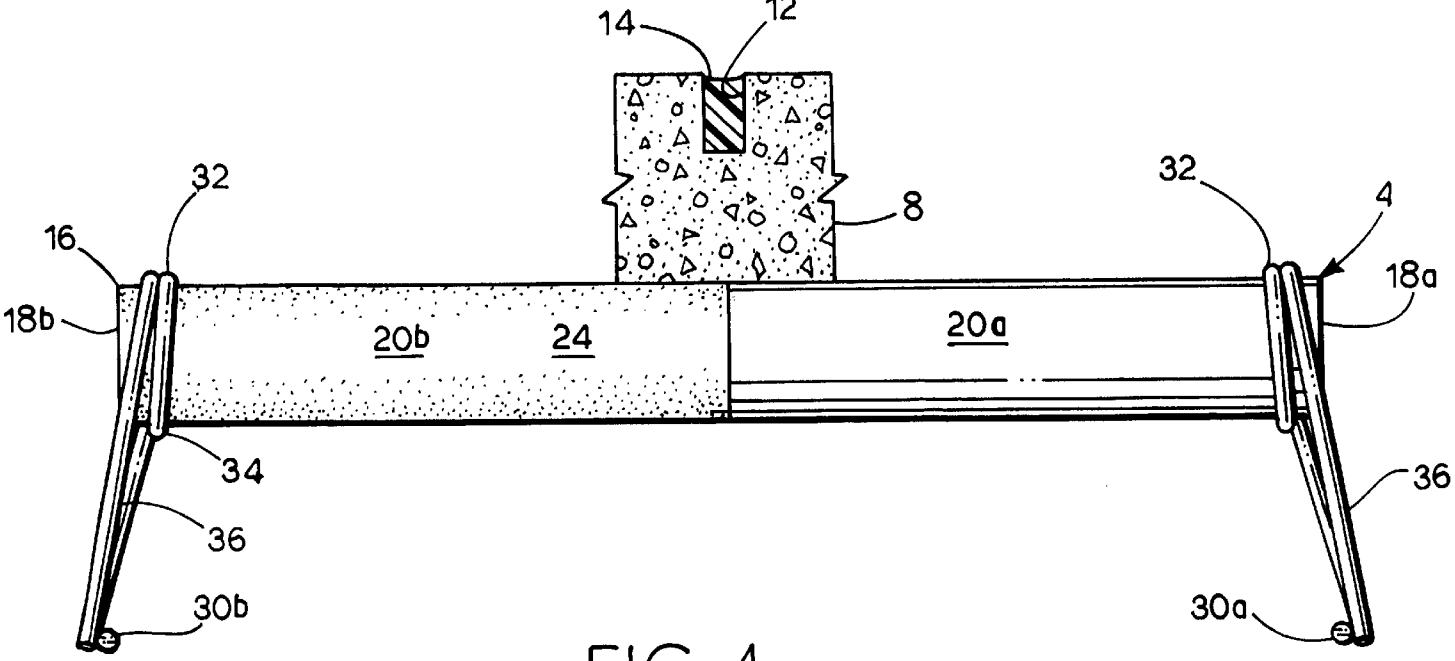
FIG. 4 is an enlarged, vertical, cross-sectional view of the tubular reinforcing dowel system, taken generally along line 4—4 of FIG. 3.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a tubular reinforcing dowel system embodying the present invention. The system 2 generally includes a plurality of dowel members 4 mounted on a basket assembly 6.

Without limitation on the generality of useful applications of the reinforcing system 2 of the present invention, it is shown in a pavement slab 8 poured over a base 10 comprising crushed rock or some other suitable base material. The slab 8 includes a saw cut construction joint 12. The construction joint 12 can include a suitable bead of caulk 14 for sealing against water infiltration.

II. Dowel Members 4

Each dowel member 4 includes a dowel tube 16 with first and second ends 18*a,b* and first and second sections 20*a,b* adjacent to its first and second ends 18*a,b* respectively. A tube bore 22 extends longitudinally, coaxially through the tube 16 between the ends 18*a,b* thereof.

The tube 16 has an outer surface 24 with a relatively smooth finish at the tube first section 20*a* and a rougher finish at the tube second section 20*b* whereby the outer surface 24 has a greater coefficient of friction at the second section 20*b* than at the first section 20*a*. The tube bore 22 is filled with a cementous material forming a rigid core 26.

The dowel members 4 can comprise a variety of suitable materials, which can be selected to meet the requirements of particular applications and to optimize performance of the dowel system 2. Without limitation on the generality of useful materials, the tubes 16 can comprise a suitable composite fiber material chosen for characteristics such as relatively high strength, flexibility and resistance to corrosion. The dowel tubes 16 can be formed by any suitable method, such as: winding; pultrusion (a continuous, filament-reinforced plastic (FRP) manufacturing process used to produce highly reinforced plastic structural shapes); injection molding; lay-up; chop/spray; etc. The tubes 16 can also comprise suitable metals, such as stainless steel.

The core 26 preferably comprises a material such as hydraulic cement which can be chosen for its relatively high compressive strength, its expansion characteristics during cure whereby the tube 16 is pre-tensioned and voids are eliminated, and a greater rigidity than the tubes 16. The core 26 resists loads placed on the dowel members 4 and pre-tensions the dowel tubes 16 by expanding in the range of about 0% to 2.2% by volume as it cures.

III. Basket Assembly 6

The basket assembly 6 includes first and second runners 30*a,b* extending horizontally in parallel, spaced relation on top of the crushed rock base 10. Each dowel member 4 is supported in spaced relation above the base 10 and the runners 30*a,b* by a pair of stands 32 connected to its ends 18*a,b*. Each stand 32 includes a circular loop 34 connected to a pair of legs 36 which depend downwardly from the loop 34 and are connected (e.g., welded) to a respective runner 30*a,b*. The stands 32 can comprise a suitable wire material, such as 5/16 inches diameter rod, with sufficient resiliency to radially grip the tube ends 18*a,b* within the stand loops 34 whereby the dowel members 4 cooperate with the basket assembly 6 to form a relatively rigid structure which can be manufactured and installed without additional cross-bracing in many applications. However, if necessary, additional cross-bracing could be provided between the runners 30*a,b* and/or the stands 32.

IV. Method and Operation

In the practice of the method of the present invention, the tubular reinforcing dowel system 2 is installed on a base 10 whereby the basket assembly 6 supports the dowel members 4 at a predetermined height above the base 10. This height is predetermined to provide sufficient top and bottom concrete cover for the dowel members 4. In the construction of a highway or roadway, for example, the basket assemblies 6 extend transversely across the path of the highway or roadway and the individual dowel members 4 extend generally longitudinally with respect to the roadway or highway. A concrete slab, such as that shown at 8, is then poured on top of the base 10 and encases the reinforcing dowel system 2. When the concrete is partially cured, the construction joint 12 can be cut in it from the top surface with a special concrete saw. Typical roadway construction involves the placement of reinforcing dowels at intervals of approximately fifteen feet. The individual dowel members 4 are longitudinally aligned with the roadway. The construction joint 12 generally overlies the medial areas of the dowel members 4. The smooth-finish first sections 20*a* of the dowel tubes 16 are located on one side of the construction joint 12 and the rough-finish second sections 20*b* of the dowel tubes 16 are located on the other side of the construction joint 12. A suitable sealing material, such as caulk 14, is installed in the construction joint 12.

In operation, the construction joint 12 is designed to provide crack control for the slab 8. The slab 8, being pre-weakened at the area of the construction joint 12, tends to crack along it, rather than cracking in random patterns elsewhere. The stresses which cause the slab 8 to crack include the dynamic loads of vehicle traffic thereover, and thermal stresses as the slab expands and contracts due to temperature changes. The relatively large cross-sectional area of the dowel members 4 distributes shear loads in the slab 8 whereby relatively large shear loads can be accommodated. The flexibility of the dowel tube 16 accommodates hinge-type bending between adjacent sections of the slab 8, i.e., on either side of the construction joint 12. The smoother finish of the dowel tube first end sections 20*a* accommodates a limited amount of slippage with respect to slab 8, while the rougher finish of the dowel tube second sections 20*b* provides a stronger bond with the slab 8. The dowel members 4 thus accommodate expansion and contraction of the sections of the slab 8 by providing limited slippage with respect thereto. Moreover, the spring action of the stand loops 34, while retaining the dowel members 4 in place in the basket assembly 6 during construction, permits slippage of the dowel members 4 when the sections of the slab 8 expand and contract with respect to each other.

The cementitious core 26 can comprise a more rigid material than the dowel tubes 16 whereby the core 26 can crack in response to bending forces exerted on the dowel members 4. The cracks which develop in the core 26 will normally have little or no significant effect on the structural performance of the dowel member 4 since the core 26, even though cracked, will continue to resist crushing of the dowel members 4 due to the compressive strength of its material. The core 26, even though cracked, can also continue to exert outward pressure, due to its expansion during curing, on the dowel tube 16.

It is to be understood that while certain forms of the present invention have been illustrated and described herein, it is not to be limited to the specific forms or arrangement of parts described and shown.

What is claimed and desired to be secured by Letters Patent is as follows:

1. A tubular reinforcing dowel system, which comprises:

a) a tubular dowel with opposite first and second ends and a dowel bore extending between and open at said ends;

b) a dowel core located within said dowel member bore and extending generally between said dowel members ends;

c) said dowel member comprising a longitudinally-extending, continuous, filament-reinforced plastic pultruded first material with first characteristics; and d) said dowel core comprising a cementitious second material with second characteristics.

2. The reinforcing dowel system according to claim 1, wherein said dowel member and said bore have circular cross-sections.

3. The reinforcing dowel system according to claim 1, wherein said dowel member and said bore thereof have round cross-sectional configurations.

4. The reinforcing dowel system according to claim 1, wherein said dowel member includes:

(a) a first section adjacent to said first end with a relatively smooth exterior finish; and (b) a second section adjacent to said second end with a relatively rough exterior finish.

5. The reinforcing dowel system according to claim 4, which includes:

(a) said first dowel member section having a smooth pultrusion finish.

6. The reinforcing dowel system according to claim 1, wherein said second material is hydraulic cement.

7. The reinforcing dowel system according to claim 1, which includes:

a) a basket assembly with a pair of basket stands each having a loop receiving said dowel member and a pair of legs extending from said loop, said loop engaging said dowel member in a gripping relation and exerting a radial inward force thereon.

8. The reinforcing dowel system according to claim 7 wherein said stands comprise continuous lengths of wire forming said loops and said legs.

9. The reinforcing dowel system according to claim 7, which includes:

a) said basket assembly including a base with a pair of longitudinal base members each connected to the legs of a respective stand.

10. A reinforcing dowel system for reinforcing a slab including a construction joint, which comprises:

(a) a plurality of dowel members each including:
  i) a dowel tube with first and second ends;
  ii) a dowel tube bore extending between said ends; and
  3) a cement core positioned in said dowel member bore;

b) a basket assembly including:
  i) first and second runners extending in parallel, spaced relation; and
  ii) a plurality of supports each mounted on a respective dowel end and including a loop receiving said dowel tube end and a pair of legs extending from said loop and connected to a respective runner; and c) each said leg assembly loop engaging a respective dowel tube end in a gripping relation and exerting a radial inward force thereon.

11. The reinforcing dowel system according to claim 10, which includes:

(a) said dowel members extending generally transversely across said joint; and (b) each said runner extending in parallel, spaced relation with respect to said joint on a respective side thereof.

12. A method of reinforcing a slab including a construction joint and a base, which comprises the steps of:

a) providing a plurality of longitudinally-extending continuous filament-reinforced plastic pultruded material dowel members each having a dowel tube with first and second ends, and a dowel tube bore extending between said dowel tube ends;

b) filling said dowel tube bores with cement to form cores;

c) forming a basket assembly with first and second runners and a plurality of supports each attached to respective runner, each said support including a loop receiving a respective dowel tube end and a pair of legs extending from said loop, said loop engaging said dowel tube in a gripping relation and exerting a radial inward force thereon, said legs being connected to a respective runner;

d) pouring concrete over said basket assembly and said dowel members;

e) forming a joint said concrete over said dowel members; and f) extending said joint in parallel, spaced relation which respect to said runners.

13. The reinforcing method according to claim 12, which includes the additional steps of:

(a) providing a relatively smooth, pultrusion finish on the outer surface of said dowel tube at a first section thereof; and (b) machining a second section of said dowel tube outer surface to provide said dowel tube outer surface at said second section with a greater coefficient of friction than said dowel tube outer surface at said first section.

14. The reinforcing method according to claim 13, which includes the additional step of:

(a) partially curing said slab; and (b) saw-cutting said slab over said dowel members between said dowel tube first and second sections.

15. The reinforcing method according to claim 12, which includes the additional step of:

(a) expanding said cement cores to pre-stress said dowel tubes.

16. The reinforcing method according the claim 15, which includes the additional step of:

(a) expanding said dowel cores in the range of 0% to approximately 2.2% by volume during cure.

* * * * *